US005547135A

United States Patent [19]

Moriya et al.

[11] Patent Number: 5,547,135

[45] **Date of Patent: * Aug. 20, 1996**

[54] MICROMILLING APPARATUS

[75] Inventors: Hiroyuki Moriya; Junichi Tomonaga; Kiyoshi Hashimoto; Kazunari Muraoka, all of Kanagawa, Japan

[73] Assignee: Fuji Xerox Co., Ltd., Tokyo, Japan

[ * ] Notice: The portion of the term of this patent subsequent to Jan. 11, 2011, has been disclaimed.

[21] Appl. No.: 224,995

[22] Filed: Apr. 8, 1994

Related U.S. Application Data

[63] Continuation of Ser. No. 85,145, Jul. 2, 1993, abandoned, which is a continuation of Ser. No. 774,997, Oct. 11, 1991, abandoned, which is a continuation-in-part of Ser. No. 592,026, Oct. 2, 1990, abandoned.

[30] Foreign Application Priority Data

Dec. 14, 1990 [JP] Japan ..... 2-410560

[51] Int. Cl.[6] ..... B02C 19/06

[52] U.S. Cl. ..... 241/40; 241/79.1

[58] Field of Search ..... 241/5, 39, 40, 241/79.1

[56] References Cited

U.S. PATENT DOCUMENTS

| | | | |
|---|---|---|---|
| 1,099,579 | 6/1914 | Stobie | 241/40 |
| 1,597,656 | 8/1926 | Morton | 241/40 X |
| 1,847,009 | 2/1932 | Kollbohm | 241/40 |
| 1,874,150 | 8/1932 | Anger | 241/40 |
| 1,935,344 | 11/1933 | Andrews et al. | 241/39 |
| 2,155,697 | 4/1939 | Young | 241/40 X |
| 3,482,786 | 12/1969 | Hogg | 241/40 X |
| 3,675,858 | 7/1972 | Stephanoff | 241/5 |
| 4,089,472 | 5/1978 | Siegel et al. | 241/40 X |
| 4,354,641 | 10/1982 | Smith | 241/40 |
| 4,451,005 | 5/1984 | Urayama | 241/40 |
| 4,504,017 | 3/1985 | Andrews | 241/40 |
| 5,133,504 | 7/1992 | Smith et al. | 241/5 |
| 5,277,369 | 1/1994 | Moriya et al. | 241/40 |

FOREIGN PATENT DOCUMENTS

| | | |
|---|---|---|
| 51-100374 | 2/1950 | Japan . |
| 51-100375 | 2/1950 | Japan . |
| 56-64754 | 10/1954 | Japan . |
| 57-84756 | 5/1982 | Japan . |
| 58-143853 | 8/1983 | Japan . |
| 63-319067 | 12/1988 | Japan . |
| 1079289A | 3/1984 | U.S.S.R. . |

*Primary Examiner*—Rinaldi I. Rada
*Assistant Examiner*—Clark F. Dexter
*Attorney, Agent, or Firm*—Finnegan, Henderson, Farabow, Garrett & Dunner, L.L.P.

[57] ABSTRACT

A micromilling device includes a milling chamber, a sorter located in the milling chamber for sorting solid material, nozzles for injecting a stream of solid particles to be milled into the chamber in a predetermined path, and impact elements positioned in the path for impacting the stream of solid material.

2 Claims, 4 Drawing Sheets

MICROMILLING APPARATUS

CROSS-REFERENCE TO THE RELATED APPLICATION

This application is a continuation, of application Ser. No. 08/085,145 filed Jul. 2, 1993, now abandoned, which is a continution of Ser. No. 07/774,997 filed Oct. 11, 1991, now abandoned, which is a continuation-in-part of Ser. No. 07/592,026 filed Oct. 2, 1990, now abandoned.

BACKGROUND OF THE INVENTION

This invention relates to an improvement of a swirl stream type jet mill with a rotary sorter or classifier, and more particularly to a micromilling apparatus improved in micromilling power consumption and in milled particle size distribution.

In general, a swirl stream type jet mill with a rotary classifier or sorter (hereinafter referred to as "an internal classification type jet mill", when applicable) operates as follows: Compressed air is jetted from micromilling nozzles to form high speed air streams, to cause particles to collide with one another, thereby to mill solid materials. In order to obtain particles having a target particle size, the particles thus processed are classified by the centrifugal force provided by the rotary classifier.

The internal classification type jet mill is advantageous in the following points: That is, since the compressed air is jetted in the above-described manner, the lowering of temperature due to its adiabatic expansion effect is caused. This phenomenon makes it possible to mill a solid material which should not be heated. In the internal classification type jet mill, the classifier is provided inside the swirl stream type jet mill. Therefore, when compared with an ordinary closed circuit system (in which the classifier is provided outside the swirl stream type jet mill), the internal classification type jet mill is smaller in the number of components, and is able to handle different kinds of particles with ease, and can readily be cleaned. In addition, in the internal classification type jet mill, collision of particles, i.e., surface milling is utilized. Therefore, the internal classification type jet mill is suitable for milling a material into ultrafine particles.

The above-described internal classification type jet mill suffers from the following difficulties: The jet mill uses a large quantity of compressed air. Accordingly, it needs a large capacity compressor. Hence, the jet mill is two times to five times greater in micromilling energy consumption than a mechanical mill. Furthermore, the jet mill utilizes collision of particles as was described above, and accordingly it is wide in milled particle distribution.

A milling machine disclosed in Japanese Patent Application (OPI) No. 319067/1988 (the term "OPI" as used herein means an "unexamined published application") is an example of the internal classification type jet mill. Normally, the speed of a swirl stream formed by the jet air is higher than the speed of rotation of the sorting rotor. Hence, in the case where the sorting rotor is set near the field of swirl streams, the effect of classification is not so high. The milling machine is still great in milling energy consumption because it is a jet mill using a compressor.

SUMMARY OF THE INVENTION

Accordingly, an object of this invention is to eliminate the above-described difficulties accompanying a conventional internal classification type jet mill.

More specifically, an object of the invention is to provide a micromilling apparatus in which, with collision members set in front of micromilling nozzles, two forces, collision between particles and collision between particles and the collision members, are utilized to use its milling energy with high efficiency, and particles are produced with a narrow milling particle distribution.

The foregoing and other objects of the invention have been achieved by the provision of a micromilling apparatus with a rotary classifier in a swirl stream type jet mill in which compressed air is jetted in a milling chamber from a plurality of micromilling nozzles to mill solid materials, in which, according to the invention, a plurality of collision members are provided in front of the plurality of micromilling nozzles in such a manner that the streams of air jetted from the micromilling nozzles collide with the collision members, respectively.

The micromilling apparatus of the invention comprises: a swirl stream type jet mill in which, in a swirl stream type micromilling chamber, compressed air is jetted from a plurality of micromilling nozzles to mill a solid material; a disk-shaped rotor provided on the jet mill; and a rotating drive unit for rotating the disk-shaped rotor. Collision members are provided in front of the micromilling nozzles in such a manner that the streams of air jetted from the nozzles collide with the collision members, respectively.

In the micromilling apparatus of the invention, each of the collision members is preferably positioned as follows: The center of the collision surface of the collision member is in a cone whose apex angle is 20° with the axis of the stream of air jetted from the micromilling nozzle at 0°. The distance between the collision surface of the collision member and the end of the nozzle is less than five (5) times as long as the potential core zone.

The collision members are made of alloy, surface-treated metal or ceramics, and they may be spherical, egg-shaped, cylindrical or cone-shaped. The size of the collision members is such that the area of its surface or section perpendicular to the axis of the stream of air jetted from the micromilling nozzle is preferably less than fifty times as large as the sectional area of the minimum inside diameter portion of the pulverizing nozzle.

In the apparatus of the invention, the streams of air jetted from the plurality of nozzles collide with the collision members provided in front of the nozzles, and therefore the compressed air energy which otherwise may be wasted can be utilized effectively. The collision of particles with the collision members increases the efficiency of the milling operation, and results in the production of particles with a narrow milled particle distribution.

BRIEF DESCRIPTION OF THE DRAWINGS

In the accompanying drawings

DESCRIPTION OF THE PREFERED EMBODIMENTS

A preferred embodiment of this invention will be described with reference to the accompanying drawings.

Figure 1:
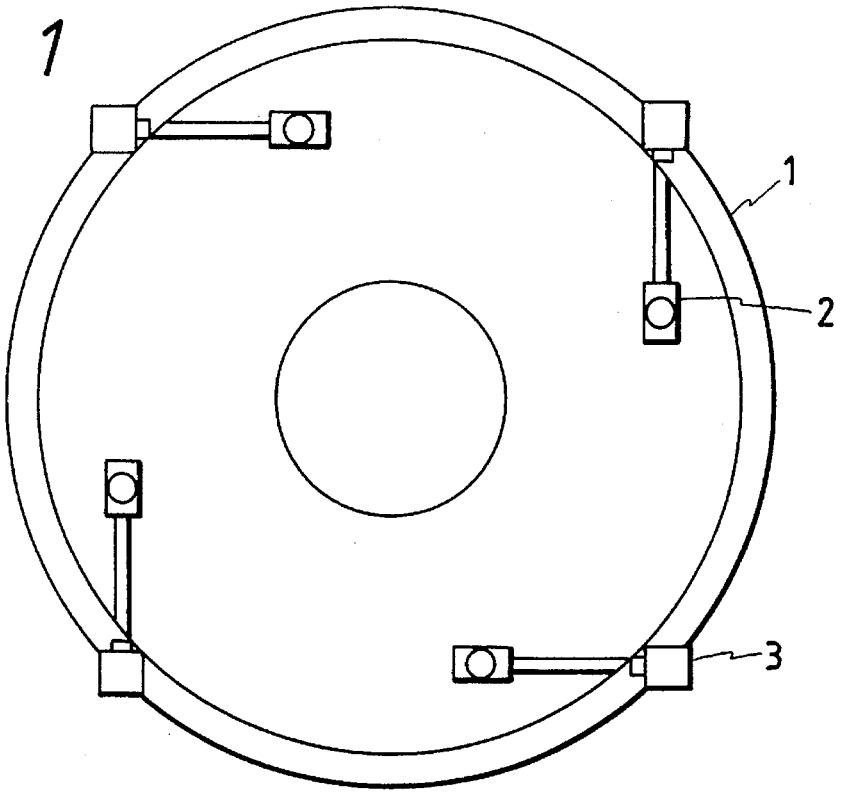
FIG. 1 is a plan view of a part of an example of a micromilling apparatus according to this invention.
Figure 2:
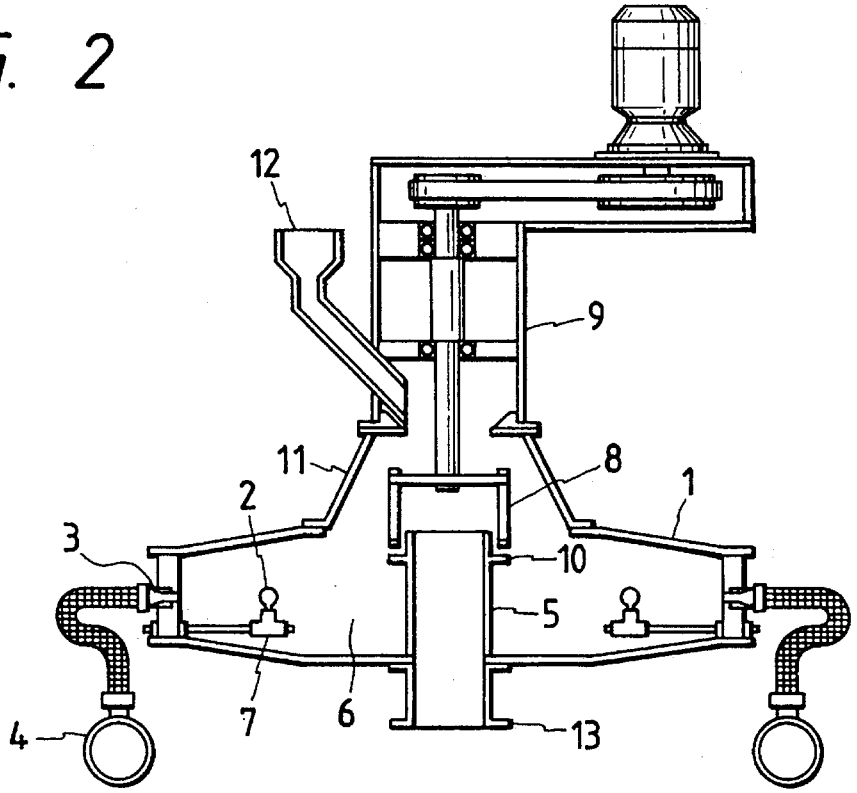
FIG. 2 is a vertical sectional view of the apparatus shown in FIG. 1.
Figure 3:
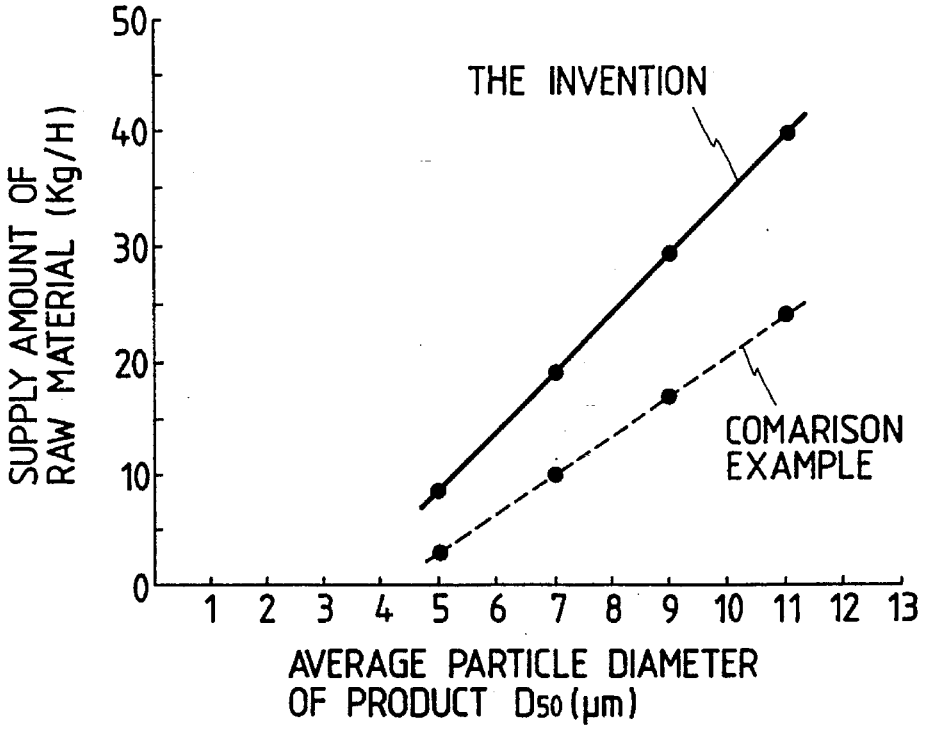
FIG. 3 is a graphical representation indicating milling energy consumption with product average particle size in the milling operations carried out with an internal classification type jet mill and a conventional internal classification type jet mill.
Figure 4:
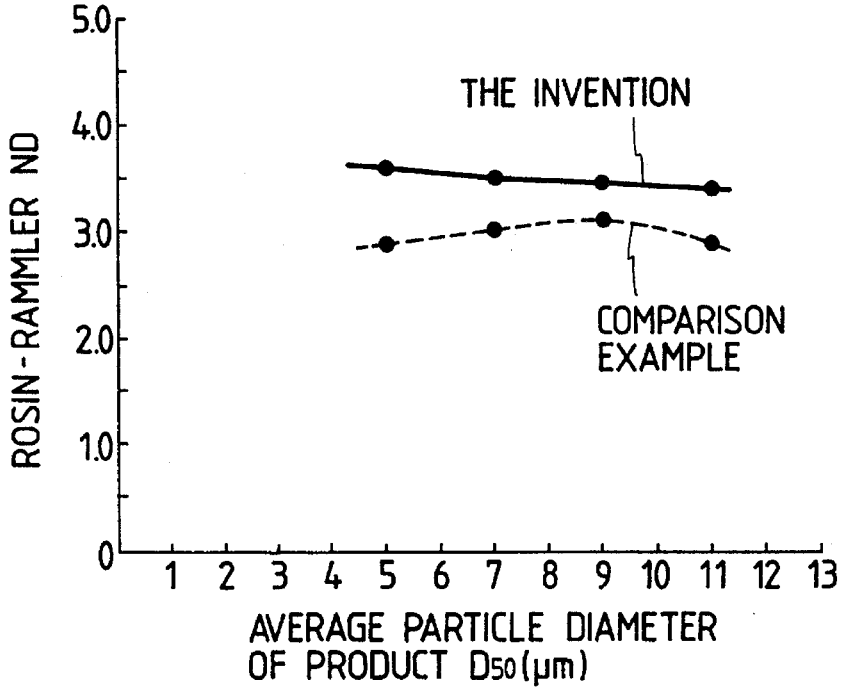
FIG. 4 is a graphical representation indicating Rosin-rammler ND with product average particle size in the milling operations carried out with the internal classification type jet mill and the conventional internal classification type jet mill.
Figure 5:
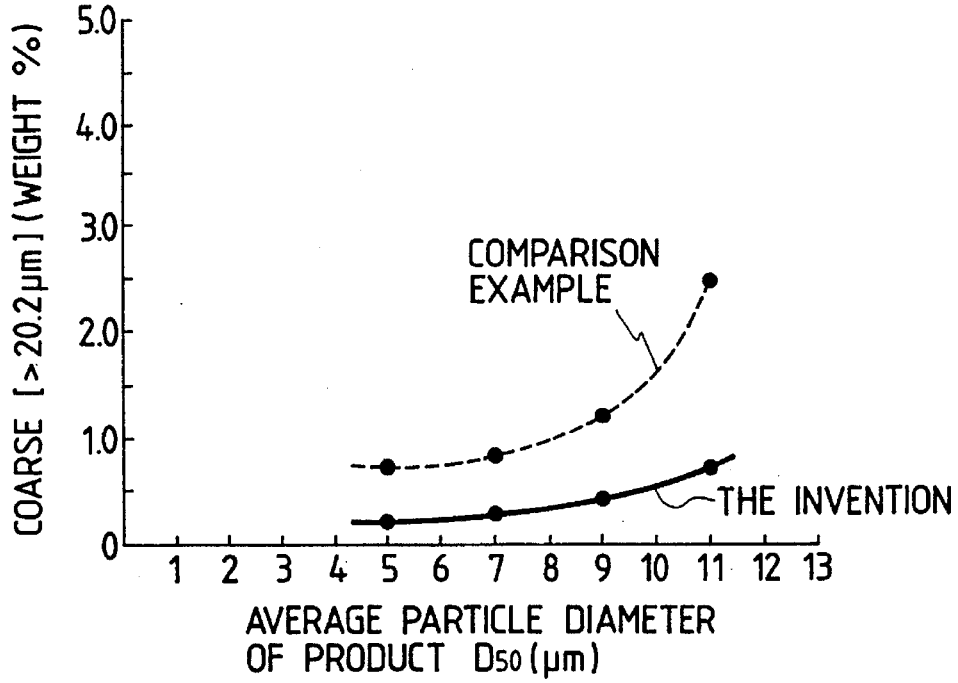
FIG. 5 is a graphical representation indicating coarse particle quantity (more than 20.2 μm) with product average particle size in the milling operations carried out with the internal classification type jet mill and the conventional internal classification type jet mill.
Figure 6:
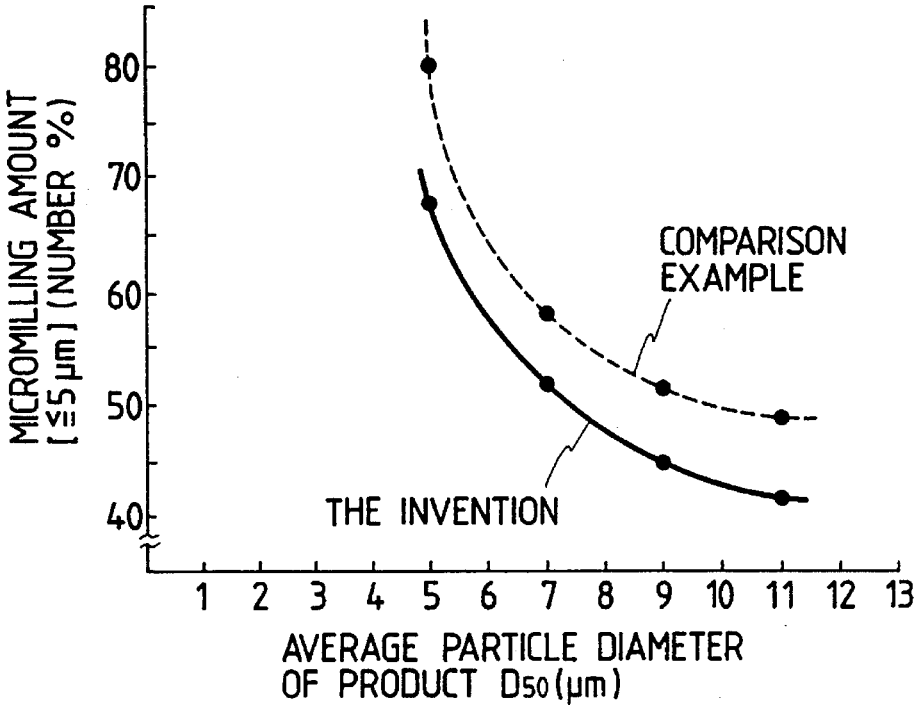
FIG. 6 is a graphical representation indicating fine particle quantity (less than 5 μm) with product average particle size in the milling operations carried out with the internal classification type jet mill and the conventional internal classification type jet mill.

In FIGS. 1 and 2, a micromilling system according to the invention comprises a micromilling apparatus body 1; collision members 2; micromilling nozzles 3; a compressed air chamber 4; a discharge pipe 5; a swirl stream type micromilling chamber 6; collision member supports 7; a rotary classifier rotor 8; a rotor-rotating drive unit 9; a ring 10 for preventing the entrance of coarse particles; and a spacer 11 an inlet chute 12 for supplying raw material, and an outlet end 13 of the discharge pipe 5.

In the apparatus, the collision members 2 are provided in the micromilling chamber 6 of the swirl stream type jet mill body 1; more specifically, the collision members 2 are provided for the nozzles 3 in the air jet directions of the latter, respectively. This construction allows one to use the compressed air energy effectively for pulverization which is otherwise wasted.

Each of the collision members 2 is positioned as follows: The center of the collision surface of the collision member is in a cone whose apex angle is 20° with the axis of the stream of air jetted from the nozzle at 0°. Preferably, the axis of the collision member 2 is in alignment with the axis of the stream of air. If the center of the collision surface of the collision member 2 is displaced from the cone exceeding 20°, then the degree is increased so that the collision surface of the collision member is displaced from the jet air stream. On the other hand, the collision surface of the collision member is spaced from the end of the nozzle as follows. That is, the distance between the collision surface of the collision member and the end of the nozzle is less than five times, preferably two or three times, as long as a so-called "potential core zone". The term "potential core zone" as used herein is intended to mean the zone in which, when compressed air is jetted from a nozzle, the air thus jetted has effective energy (the potential core zone is generally five times as long as the inside diameter of the nozzle). If the distance is more than five times, then the following difficulties may be encountered: The speed of particles is decreased, so that the energy of collision is lowered, or the streams of air jetted the other nozzles are disturbed, or the swirl stream having a particle classifying function is disturbed; that is, the micromilling effect is decreased.

Figure 7C:
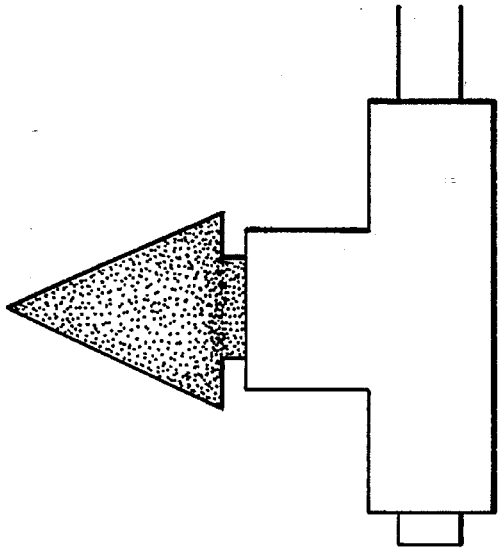
FIGS. 7*a*, 7*b* and 7*c* are side views of three different shapes of the collision members.
Figure 7B:
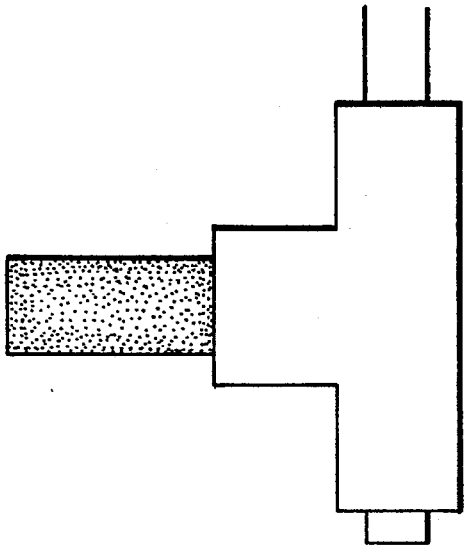
Figure 7A:
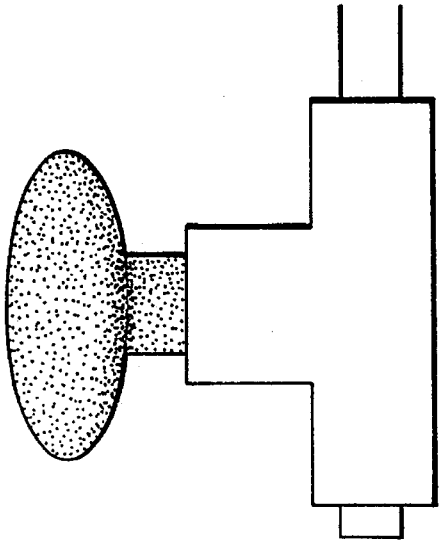

Each collision member may be spherical, egg-shaped cylindrical, or in the form of a cone, as shown in Figs. 7*a*, 7*b* and 7*c*, respectively; however, preferably it is spherical. In addition, the size of the collision member should be determined to the extent that it will not disturb the streams of air jetted from the other nozzles, nor the swirl stream. It is preferable that the area of the surface or section perpendicular to the axis of the stream of air jetted from the nozzle is not more than fifty (50) times the sectional area of the portion of the nozzle which is at the minimum inside diameter.

The collision members may be made of any material high in wear resistance, preferably wear resisting alloys, wear resisting surface-treated metals, or ceramics. More specifically, examples of the wear resisting alloys are carbide, cobalt-based stellite alloy, nickel-based Deloro alloy, iron-based Delchrome alloy, Tristyl alloy, and Trivalloy intermetallic compound. Examples of the ceramics are oxides such as alumina, titania and zirconia, carbides such as silicon carbide and chromium carbide, nitrides such as silicon nitride and titanium nitride, borides such as chromium boride and titanium.

Concrete examples of a milling operation carried out with the micromilling apparatus according to the invention will be described.

The apparatus shown in FIGS. 1 and 2 was used. More specifically, the apparatus was made up of the swirl stream type micromilling chamber 420 mm in inside diameter and 50 mm in height, the spacer 100 mm in height, the discharge pipe 100 mm in inside diameter and 160 mm in length at the center of the bottom of the swirl stream type micromilling chamber, and the classifier rotor with seventy-two vanes 148 mm in diameter. Four Laval nozzles were employed as the pulverizing nozzles, and were arranged on the cylindrical wall of the swirl stream type micromilling chamber in such a manner that each of the nozzles forms 35° with respect to the radial direction of the micromilling chamber. The raw material was supplied through a raw material supplying inlet or chute 12 provided above the classifier rotor 8. The milling operation was carried out under the following conditions:

CONCRETE EXAMPLE 1

Collision members

Number: 4

Distance from the nozzle: 80 mm

Configuration: Cylinder shape

Size: 16 mm in diameter ×35 mm in length

Material: SUS 304

Micromilling conditions

Micromilling pressure: 7.6 kg/cm$^2$G

Exhaust gas flow rate: 11 to 12 m$^3$/min

The raw material was hammer-milled electro-photographing toner (weight average particle size $D_{50}$=300 to 500 μm). The raw material was milled to a weight average particle size $D_{50}$ of 11 μm, and the particle size distribution was measured with a "Coulter counter" TA-II (manufactured by Coulter Electronics Co.).

COMPARISON EXAMPLE 1

The apparatus was used which was equal to the micromilling apparatus in the above-described Concrete Example 1 except that it had no collision members in the micromilling chamber. With the apparatus, a pulverizing operation was carried out to $D_{50}$=11 μm under the same conditions as those in concrete example 1. The results of the micromilling operation are as listed in the following Table 1. In the micromilling operations, raw material supply quantities, Rosin-Rammler ND, and coarse particle quantities, and fine particle quantities were as shown in FIGS. 3, 4, 5 and 6, respectively.

CONCRETE EXAMPLE 2

A micromilling operation was carried out to $D_{50}$=11 μm under the conditions which were equal to the conditions in the above-described concrete example 1 except that the central axis of the collision surface of each of the collision members was accurately in alignment with the axis of the stream of air jetted from the respective nozzle.

CONCRETE EXAMPLE 3

A micromilling operation was carried out to $D_{50}$=11 μm under the conditions which were equal to the conditions in the above-described concrete example 1 except that the central axis of the collision surface of each of the collision members was swung horizontally towards the cylindrical wall of the milling chamber to form 15° with the axis of the direction of the stream of air jetted from the respective milling nozzle.

CONCRETE EXAMPLE 4

A micromilling operation was carried out to $D_{50}$=11 μm under the conditions which were equal to the conditions in the above-described concrete example 2 except that the distance of each of the collision members (i.e., the distance between the collision surface of the collision member and the end of the milling nozzle) was set to 60 mm.

CONCRETE EXAMPLE 5

A micromilling operation was carried out to $D_{50}$=11 μm under the conditions which were equal to the conditions in the above-described concrete example 2 except that the distance of each of the collision members was set to 140 mm.

CONCRETE EXAMPLE 6

A micromilling operation was carried out to $D_{50}$=11 μm under the conditions which were equal to the conditions in the above-described concrete example 4 except that each of the collision members was spherical (16 mm in diameter).

CONCRETE EXAMPLE 7

A micromilling operation was carried out to $D_{50}$=11 μm under the conditions which were equal to the conditions in the above-described concrete example 4 except that each of the collision members was in the form of a quadrangular prism (16 mm ×16 mm ×16 mm), and a flat surface of the quadrangular prism faced the respective pulverizing nozzle.

CONCRETE EXAMPLE 8

A micromilling operation was carried out to $D_{50}$=11 μm under the conditions which were equal to the conditions in the above-described concrete example 4 except that each of the collision members was spherical (30 mm in diameter). In the micromilling operations, raw material supply quantities, Rosin-Rammler ND, and coarse particle quantities, and fine particle quantities were as shown in FIGS. 3, 4, 5 and 6, respectively.

CONCRETE EXAMPLE 9

A micromilling operation was carried out to $D_{50}$=9 μm, 7 μm, and 5 μm under the conditions which were equal to those in the above-described concrete example 8. In the micromilling operations, raw material supply quantities, Rosin-Rammler ND, and coarse particle quantities, and fine particle quantities were as shown in FIGS. 3, 4, 5 and 6, respectively.

COMPARISON EXAMPLE 2

A micromilling operation was carried out to $D_{50}$=9 μm, 7 μm, and 5 μm under the conditions which were equal to those in the above-described comparison example 1.

TABLE 1

| | Collision member | | | Milling energy consumption | | Particle size distribution | | | |
|---|---|---|---|---|---|---|---|---|---|
| | Configuration | Set position (°C.) | Set distance | Total (KWH/Kg) | Milling (KWH/Kg) | $D_{50}$ (μm) | Fine (<5 μm) pop % vol % | Coarse (<20.2 μm) vol % | Rosin-Rammler ND |
| Concrete Example 1 | Cylinder (16 mmϕ × 35 mm) | 0–5 | 80 | 4.18 | 1.39 | 11.1<br>1 | 47.7<br>7.2 | 1.08 | 3.17 |
| Comparison Example 1 | — | — | — | 5.43 | 1.81 | 11.1<br>3 | 48.2<br>7.40 | 2.50 | 2.80 |
| Concrete Example 2 | Cylinder (16 mmϕ × 35 mm) | 0 | 80 | 3.88 | 1.29 | 11.0<br>0 | 45.0<br>7.0 | 0.64 | 3.22 |
| Concrete Example 3 | Cylinder (16 mmϕ × 35 mm) | 30 | 80 | 4.80 | 1.60 | 11.0<br>5 | 47.5<br>7.2 | 1.50 | 3.00 |
| Concrete Example 4 | Cylinder (16 mmϕ × 35 mm) | 0 | 60 | 3.61 | 1.20 | 11.1<br>0 | 44.0<br>6.8 | 0.50 | 3.30 |
| Concrete Example 5 | Cylinder (16 mmϕ × 35 mm) | 0 | 140 | 5.00 | 1.66 | 11.1<br>4 | 46.5<br>7.0 | 2.20 | 2.98 |
| Concrete Example 6 | Sphere (16 mmϕ) | 0 | 60 | 3.33 | 1.11 | 11.0<br>0 | 42.3<br>6.5 | 0.30 | 3.35 |
| Concrete Example 7 | Quadrangular shape (16 × 16 × 30 mm) | 0 | 60 | 5.22 | 1.74 | 10.9<br>0 | 48.0<br>7.5 | 5.20 | 2.33 |
| Concrete Example 8 | Sphere (30 mmϕ) | 0 | 60 | 2.93 | 0.98 | 11.1<br>2 | 41.8<br>6.4 | 0.2 | 3.41 |
| Concrete Example 9 | Sphere (37 mmϕ) | 0 | 60 | 4.44 | 1.48 | 11.0<br>7 | 46.0<br>6.9 | 2.7 | 3.01 |

As is apparent from comparison between the concrete examples and the comparison examples, the provision of the collision members in the swirl stream type milling chamber resulted in a reduction in milling energy consumption. In addition, both the coarse particle quantity and the fine particle quantity were less, and the particle size distribution was sharp (FIGS. 3 through 6).

It can be understood from comparison of concrete examples 1 through 3 that, by optimizing the position of each of the collision members (i.e., the angle formed between the central axis of the collision surface of the collision member and the axis of the stream of air jetted from the nozzle), the milling energy consumption can be further reduced. Judging from the diffusion of the air jetted from the nozzle (or a Laval nozzle) and the results of concrete example 3, the position of the milling nozzle should be within ±10°, preferably 0°, from the axis (0°) of the nozzle (or in the cone whose vertical angle is 20° or less around the axis of the stream of air jetted from the nozzle) so that the energy of the compressed air can be effectively utilized.

It has been confirmed from comparison of concrete examples 2, 4 and 5 that the energy consumption can be further decreased by optimizing the distance of each of the collision members from the respective nozzle. The best distance depends on the kind of powder to be handled. However, when a potential core zone which is maximum in the energy of compressed air jetted from the nozzle, entrainment of particles, an acceleration zone, an inference zone with the streams of air jetted from the other nozzles, and interference with a swirl dispersion zone are taken into account, then the potential core zone is 26 mm (5×5.2 mm: nozzle inside diameter). Therefore, the distance should be in a range of from 0 mm to 130 mm which is equal to or less than five times 26 mm.

It has been confirmed from comparison of concrete examples 4, 6 and 7 that the milling energy consumption can be further decreased by optimizing the configuration of each of the collision members. The milling member should be so shaped as not to disturb the stream of air jetted from the nozzle. That is, the milling members may be spherical, egg-shaped, cylindrical or cone-shaped. The spherical milling member is most effective.

In addition, it has been confirmed from comparison of concrete examples 8 and 9 that the milling energy consumption can be further decreased by optimizing the size of each of the collision members. Depending on the spread of the air jetted from the nozzle and the range of position of the collision member, the size of each collision member preferably is less than fifty (50) times the sectional area of the minimum inside diameter portion of the nozzle. In the cases of concrete examples 8 and 9, fifty times the sectional area of the minimum inside diameter portion of the nozzle was 1061 $mm^2$ (=¼×(5.2) 2×3.14×50). In concrete example 8, the size of the collision member was 707 $mm^2$; and in concrete example 8, 1075 $mm^2$.

Furthermore, it has been confirmed from comparison of concrete example 10 that the milling energy consumption is decreased over a wide range of milled particle sizes, and the pulverizing operation is carried out with a sharp pulverized particle size distribution.

CONCRETE EXAMPLE 10

A micromilling operation was carried out with the apparatus used in the above-described concrete examples 1 through 9. The four collision members provided for the four nozzles were of carbide (WH40, manufactured by Hitachi Metal Co., Ltd.), powder high speed tool steel (HAP40 manufactured by Hitachi Metal Co., Ltd.), Sialon (HCN10 manufactured by Hitachi Metal Co., Ltd.), and SUS 304. Under the same conditions as those in concrete example 2, a raw material, hammer-milled resin containing magnetic powder (300 to 500 μm), was milled for four hours with a raw material supplying rate of 20 kg/H, and the change in weight (i.e., the degree of wear) of each of the collision member was measured. In order to minimize the difference in measurement of the collision members, the positions of the latter were swapped with one another every hour. The results of the measurement are as indicated in the following Table 2:

TABLE 2

| Material | Milling hours (hr) 1 | 2 | 3 | 4 | Average | Wear resistance rate |
|---|---|---|---|---|---|---|
| Carbide | $5.4 \times 10^{-3}$ | $7.3 \times 10^{-3}$ | $7.3 \times 10^{-3}$ | $5.8 \times 10^{-3}$ | $2.58 \times 10^{-2}$ | 96.6 |
| HAP40 | $1.0 \times 10^{-2}$ | $0.8 \times 10^{-2}$ | $0.8 \times 10^{-2}$ | $0.4 \times 10^{-2}$ | $3.5 \times 10^{-2}$ | 71.2 |
| Sialon | $1.0 \times 10^{-2}$ | $1.2 \times 10^{-2}$ | $1.3 \times 10^{-2}$ | $1.0 \times 10^{-2}$ | $4.5 \times 10^{-2}$ | 55.4 |
| SUS304 | $69.5 \times 10^{-2}$ | $61.3 \times 10^{-2}$ | $63.5 \times 10^{-2}$ | $54.9 \times 10^{-2}$ | 2.492 | 1 |

Note:
Degree of wear: $(W_{i-1} - W_i)/W_{i-1} \times 100$ (i = 1, 2, 3, 4)
[W is the collision member material (g), and 1 is the sampling hours (hr).

As is seen from Table 2, the wear resistance of the collision member of carbide is 96.6 times as high as that of the collision member of SUS 304, the wear resistance of the collision member of HAP40 is 71.2 times, and the wear resistance of the collision member of Sialon is 55.4 times. That is, the collision members of carbide, HAP40 and Sialon were excellent in wear resistance.

As was described above, in the apparatus of the invention, the collision members are provided in front of the nozzles, respectively. This construction contributes to a reduction in milling energy consumption over a wide range of milled particle sizes and permits a milling operation with a narrow milled particle size distribution. In addition, with the apparatus, even particles high in abrasion hardness can be milled by the use of the collision members high in wear resistance.

What is claimed is:

1. A device for micromilling solid particles, comprising:

a generally cylindrical milling chamber having an open interior space;

an inlet for introducing solid particles to the open interior space;

sorting means located within said milling chamber for retaining oversize solid particles within the open interior space;

a plurality of injection means for injecting a plurality of streams of compressed air into said milling chamber, independently from the introduction of solid particles to said open interior space, in predetermined paths, respectively, to accelerate the solid particles in the open interior space of said milling chamber along said predetermined paths; and a plurality of discrete impact elements located within the open interior space of said milling chamber, one of said discrete elements located in each of said predetermined paths, said impact elements impacting with said solid particles accelerated by said injection means and deflecting said solid particles accelerated by said injection means to cause said deflected solid particles to collide with other solid particles retained in said open interior space, said impact elements having a shape of one of a sphere, an egg, a cylinder, and a once;

each of said injection means being oriented such that a line bisecting the injection means and a respective one of said impact elements forms an angle other than 0° with a radial line passing through the injection means and bisecting the cylindrical milling chamber.

2. A device for micromilling solid particles, comprising:

a generally cylindrical milling chamber having an open interior space;

an inlet for introducing solid particles to the open interior space;

sorting means located within said milling chamber for retaining oversize solid particles within the open interior space;

at least four flow nozzles directed into said milling chamber for injecting streams of compressed air into said milling chamber, independently from the introduction of solid particles to said open interior space, each of said nozzles injecting air in a predetermined path to accelerate the solid particles in said milling chamber along said predetermined path; and at least four discrete impact elements located within the open interior space of said milling chamber, one of said elements in each said predetermined path of said nozzles, said impact elements impacting with said solid particles accelerated by said nozzles and deflecting said solid particles accelerated by said nozzles to cause said deflected solid particles to collide with other solid particles retained in said milling chamber, each said impact element having a shape of one of a sphere, an egg, a cylinder, and a cone;

each of said nozzles being oriented such that a line bisecting the nozzle and a respective one of said impact elements forms an angle other than 0° with a line passing through the nozzle and bisecting the milling chamber.

* * * * *

UNITED STATES PATENT AND TRADEMARK OFFICE

CERTIFICATE OF CORRECTION

PATENT NO. : 5,547,135

DATED : August 20, 1996

INVENTOR(S) : Hiroyuki MORIYA et al.

It is certified that error appears in the above-indentified patent and that said Letters Patent is hereby corrected as shown below:

Claim 1, column 9, line 12, "once" should read --cone--.

Signed and Sealed this

Twenty-fourth Day of December, 1996

*Attest:*

Bruce Lehman

BRUCE LEHMAN

*Attesting Officer*

*Commissioner of Patents and Trademarks*